US008833009B2

(12) United States Patent
Pendley et al.

(10) Patent No.: US 8,833,009 B2
(45) Date of Patent: Sep. 16, 2014

(54) RAIL MOUNTING SYSTEMS ON ROOFS

(71) Applicants: Timothy Pendley, Madera, CA (US); Michael J. McLain, Green Bay, WI (US)

(72) Inventors: Timothy Pendley, Madera, CA (US); Michael J. McLain, Green Bay, WI (US)

(73) Assignee: T&M Inventions, LLC, Green Bay, WI (US)

( * ) Notice: Subject to any disclaimer, the term of this patent is extended or adjusted under 35 U.S.C. 154(b) by 0 days.

(21) Appl. No.: 13/771,746

(22) Filed: Feb. 20, 2013

(65) Prior Publication Data

US 2013/0219825 A1 Aug. 29, 2013

Related U.S. Application Data

(63) Continuation of application No. 12/932,892, filed on Mar. 8, 2011, now Pat. No. 8,438,798, which is a continuation-in-part of application No. 12/572,176, filed on Oct. 1, 2009, now abandoned.

(60) Provisional application No. 61/102,333, filed on Oct. 2, 2008.

(51) Int. Cl.
*E04D 13/02* (2006.01)

(52) U.S. Cl.
USPC ..... 52/200

(58) Field of Classification Search
USPC ..... 52/200, 18, 19, 72, 80.1, 90.1, 90.2, 52/91.1, 202
See application file for complete search history.

(56) References Cited

U.S. PATENT DOCUMENTS

| | | | | |
|---|---|---|---|---|
| 3,521,414 | A | | 7/1970 | Malissa |
| 3,791,088 | A | | 2/1974 | Sandow et al. |
| 3,828,494 | A | | 8/1974 | Uhrhane et al. |
| 3,967,423 | A | | 7/1976 | Hammond |
| 4,117,638 | A | * | 10/1978 | Kidd et al. ..... 52/200 |
| 4,123,883 | A | | 11/1978 | Barber, Jr. et al. |
| 4,155,206 | A | | 5/1979 | Player |

(Continued)

FOREIGN PATENT DOCUMENTS

| | | |
|---|---|---|
| GB | 981948 | 2/1965 |
| JP | 2000336859 | 5/2000 |

(Continued)

OTHER PUBLICATIONS

FAA Facility, photos of skylight installation, 3 pages, Sacramento, CA, prior to 2007.

(Continued)

*Primary Examiner* — Andrew J Triggs
(74) *Attorney, Agent, or Firm* — Thomas D. Wilhelm; Wilhelm Law, S.C.

(57) ABSTRACT

The invention provides a rail mounting system for attachment to elevated rib structure of a metal panel roof whereby the rib structure underlies and supports the rail mounting system at side rails and correspondingly the rib structure underlies and supports any load being supported by the side rails. First and second side rails can be attached to first and second rib structures, thereby supporting the load from the first and second rib structures. End closures can extend across the space between such first and second side rails at opposing ends of the side rails, thereby closing off the openings between the ends of the side rails and providing a closed support structure extending about the encompassed space and closing off laterally-directed access to the enclosed space.

16 Claims, 18 Drawing Sheets

(56) References Cited

U.S. PATENT DOCUMENTS

| | | | | |
|---|---|---|---|---|
| 4,296,581 | A | 10/1981 | Heckelsberg | |
| 4,470,230 | A | 9/1984 | Weisner | |
| 4,520,604 | A | 6/1985 | Halsey et al. | |
| 4,543,753 | A | 10/1985 | Sonneborn et al. | |
| 4,559,753 | A * | 12/1985 | Brueske | 52/748.1 |
| 4,621,466 | A | 11/1986 | Sonneborn et al. | |
| 4,649,680 | A * | 3/1987 | Weisner et al. | 52/200 |
| 4,703,596 | A | 11/1987 | Sandow | |
| 4,730,426 | A | 3/1988 | Weisner et al. | |
| 4,776,141 | A | 10/1988 | Powell | |
| 4,825,608 | A | 5/1989 | Makin | |
| 4,848,051 | A | 7/1989 | Weisner et al. | |
| 4,860,511 | A * | 8/1989 | Weisner et al. | 52/200 |
| 4,941,300 | A | 7/1990 | Lyons, Jr. | |
| 4,986,039 | A | 1/1991 | Weisner | |
| 5,027,576 | A | 7/1991 | Gustavsson | |
| 5,323,576 | A * | 6/1994 | Gumpert et al. | 52/200 |
| 5,511,354 | A | 4/1996 | Eidson | |
| 5,522,189 | A | 6/1996 | Mortensen et al. | |
| 5,553,425 | A | 9/1996 | Sampson et al. | |
| 5,561,953 | A | 10/1996 | Rotter | |
| 5,896,711 | A | 4/1999 | McClure | |
| 5,960,596 | A | 10/1999 | Lyons, Sr. | |
| 6,079,167 | A | 6/2000 | Voegele, Jr. | |
| 6,151,838 | A | 11/2000 | Husein | |
| 6,640,508 | B2 | 11/2003 | Lindgren et al. | |
| 6,775,951 | B2 * | 8/2004 | Gumpert et al. | 52/200 |
| 6,966,157 | B1 * | 11/2005 | Sandow | 52/200 |
| 7,043,882 | B2 * | 5/2006 | Gumpert et al. | 52/200 |
| 7,263,807 | B2 * | 9/2007 | Gumpert | 52/200 |
| 7,296,388 | B2 | 11/2007 | Valentz et al. | |
| 7,308,777 | B2 * | 12/2007 | Sandow | 52/200 |
| 7,395,636 | B2 | 7/2008 | Blomberg | |
| 7,712,279 | B2 | 5/2010 | McClure | |
| 7,721,493 | B2 | 5/2010 | Skov et al. | |
| 7,736,014 | B2 | 6/2010 | Blomberg | |
| 8,438,798 | B2 * | 5/2013 | McLain et al. | 52/200 |
| 8,438,799 | B2 * | 5/2013 | McLain et al. | 52/200 |
| 8,438,800 | B2 * | 5/2013 | McLain et al. | 52/200 |
| 8,438,801 | B2 * | 5/2013 | McLain et al. | 52/200 |
| 8,448,393 | B2 * | 5/2013 | Voegele et al. | 52/200 |
| 8,561,364 | B2 * | 10/2013 | Pendley et al. | 52/200 |
| 8,567,136 | B2 * | 10/2013 | Pendley et al. | 52/200 |
| 2002/0026756 | A1 * | 3/2002 | Gumpert et al. | 52/200 |
| 2004/0049996 | A1 | 3/2004 | Blomberg | |
| 2005/0016090 | A1 * | 1/2005 | Gumpert et al. | 52/200 |
| 2005/0204674 | A1 | 9/2005 | Marshall | |
| 2006/0191230 | A1 * | 8/2006 | Gumpert | 52/519 |
| 2007/0094984 | A1 | 5/2007 | McClure | |
| 2007/0101665 | A1 * | 5/2007 | Sandow | 52/200 |
| 2008/0040993 | A1 | 2/2008 | Valentz et al. | |
| 2008/0190050 | A1 | 8/2008 | McClure | |
| 2010/0162643 | A1 * | 7/2010 | Blomberg et al. | 52/200 |
| 2010/0269426 | A1 * | 10/2010 | Richter et al. | 52/171.3 |
| 2011/0154751 | A1 * | 6/2011 | Gumpert | 52/200 |
| 2011/0252726 | A1 * | 10/2011 | McLain et al. | 52/200 |
| 2011/0252727 | A1 * | 10/2011 | McLain et al. | 52/200 |
| 2012/0233941 | A1 * | 9/2012 | McLain et al. | 52/200 |
| 2012/0233942 | A1 * | 9/2012 | McLain et al. | 52/200 |
| 2013/0031855 | A1 * | 2/2013 | Blomberg et al. | 52/199 |
| 2013/0167459 | A1 * | 7/2013 | Pendley et al. | 52/200 |
| 2013/0219825 | A1 * | 8/2013 | Pendley et al. | 52/710 |
| 2013/0239489 | A1 * | 9/2013 | Pendley et al. | 52/97 |
| 2013/0239500 | A1 * | 9/2013 | Pendley et al. | 52/302.1 |
| 2013/0239513 | A1 * | 9/2013 | Pendley et al. | 52/742.12 |
| 2014/0020314 | A1 * | 1/2014 | Pendley et al. | 52/200 |

FOREIGN PATENT DOCUMENTS

| | | |
|---|---|---|
| JP | 2001214577 | 8/2001 |
| JP | 2008202372 | 9/2008 |
| WO | 2010040006 | 4/2010 |

OTHER PUBLICATIONS

Cross-section and pictorial views of SSR-TUF-Lite daylighting panels, received Jun. 20, 2012, 1 sheet.

Cross-section of VP TUF-Lite Panel—attached to the side of SSR rib, received Jun. 20, 2012, 1 sheet.

Cross-section of Butler Lite Panel—attached to the side of MR24 rib, received Jun. 20, 2012, 1 sheet.

Siemens Building, photos of skylight installation, 6 pages, prior to 2007.

R & S Manufacturing and Sales Company, Inc., Standing Seam 24 Light, Quick Installation Instructions, Under/Over Seam Clip, 12 pages, Newbury Park, CA, date unknown.

R & S Manufacturing and Sales Company, Inc., SS 24 Light, The First Truely Thermally Broken Metal Building Skylight, informational sheet, 1 page, Newbury Park, CA, date unknown.

R & S Manufacturing and Sales Company, Inc., Enlarged sketch of metal roof showing the down slope, 1 page, Newbury Park, CA, date unknown.

DALJCON, LLC., Butler Manufacturing, www.daljcon.com, Example of Standing Seam, printed Dec. 11, 2012.

* cited by examiner

RAIL MOUNTING SYSTEMS ON ROOFS

REFERENCE TO RELATED APPLICATION

This application is a Continuation of U.S. Non-Provisional patent application Ser. No. 12/932,892, filed Mar. 8, 2011, which is a Continuation-in-Part of U.S. Non-Provisional patent application Ser. No. 12/572,176, filed Oct. 1, 2009, which is a Non-Provisional of U.S. Provisional Patent Application. No. 61/102,333, filed Oct. 2, 2008, the complete disclosures of which are incorporated herein, in their entireties.

A portion of the disclosure of this patent document contains material which is subject to copyright protection. The copyright owner has no objection to the facsimile reproduction by anyone of the patent document or the patent disclosure, as it appears in the Patent and Trademark Office patent files and records, but otherwise reserves all other copyright rights.

BACKGROUND OF THE INVENTION

1. Field of the Invention

The field of the invention is skylights systems.

2. Description of Related Art

Various systems are known for using curb construction for inserting skylights and smoke vents into roofs.

The most commonly used skylighting systems are those that incorporate translucent or transparent layers in a framework that penetrates the roof structure, so as to allow ambient daylight into the building.

In the past roof penetrating installations have required a complex structure beneath the roofing panels in order to support a roof curb to which the skylight was attached. Skylight curbs are generally in the form of a preassembled box structure, that is fixed within a roof cutout. The retrofitting of such curb systems into existing roof structure is problematic.

U.S. Pat. No. 4,296,581, to Heckelsberg, issued Oct. 27, 1981, provides an example of a roofing structure of the type that is constructed of a series of metal panels having flanges that interlock when the panels are laid side by side and which are subsequently tightly seamed together to convert the individual panels into an integrated roof forming membrane. This roof structure is mounted to the purlins with clips that permit the panels to expand or contract in response to temperature and pressure changes, thereby minimizing roof stressing.

U.S. Pat. No. 4,703,596, to Sandow, issued Nov. 3, 1987, and titled "Grid Skylight System", provides a grid skylight support apparatus that includes prefabricated grid row frames, each of which form a number of connected beam supports which define a number of bays. Each bay has a skylight curb formed by upper flanges of the beam supports to receive a preassembled skylight unit. The sides of each grid row frame provide a mating edge that can register with the mating edge of an adjacent grid row frame during assembly. The skylights have peripheral support skirts that register upon each bay and a light-transmitting skylight panel to cover the peripheral support. Cross gutters on each grid row frame, which are positioned between adjacent skylights, extend at an angle toward the mating edge of the grid row frame for carrying rainwater to a main gutter channel formed by field-assembly of the mating edges of two adjacent grid row frames. The main gutter channel includes a pair of longitudinally extending gutter sections, each of which have a main gutter channel surface with a lower elevation than the elevation of the cross flow channel. Fasteners assemble the grid row frame mating edges together and a continuous seal to prevent rainwater leakage at the mating edges of adjacent grid row frames.

U.S. Pat. No. 4,520,604, to Halsey et al., issued Jun. 4, 1985, entitled "Skylight Structure", teaches a curb structure that is dimensioned to be passed through an opening in a roof and then attached in moisture impervious relation to the roof from within a building interior. A skylight assembly including a frame and light transmitting member secured to the frame is dimensioned to be passed through the opening and attached in a sealing engagement to the curb structure from within the building interior for covering the opening. The skylight assembly is then secured to the rafters and headers at an interior location. The frame includes upper and lower clamping jaws and spaced fulcrum links attached to the jaws for clamping the light transmitting member thereto. The lower clamping jaw includes a channel which engages and is interlocked with the curb structure.

Other skylight systems, as contemplated in U.S. Pat. No. 4,470,230, by Weinser, provide a prefabricated skylight support curb that is formed to be a protective packaging for the skylight during shipment and then used as a curb for mounting the skylight on a roof. A prefabricated skylight support curb for supporting a skylight thereover has a bottom flange angled, upright sides, and a top lip round the top of the sides forming an opening through the curb. A skylight is adapted to cover the opening through the skylight support curb when installed, and has a domed portion and an angled portion extending from the dome portion and a drip edge on the curb portion. The skylight curb portion is shaped to fit over a portion of the prefabricated skylight support curb angled upright portion and top lip. The skylight support curb is shaped to nest an accompanying skylight therein having the skylight curb portion adjacent to the interior of the skylight support curb angled upright walls to protect the skylight during shipping and storing.

In another skylight system, as contemplated in U.S. Pat. No. 3,791,088, by Sandow, at al., a prefabricated multiple dome unit or skylights and composite is provided, wherein each multiple dome unit has several domes of transparent or translucent material mounted together on a common frame, and wherein means are provided for assembling a plurality of such dome units into a composite thereof on a building, with the units lapped and interfitted so as to provide a continuous drainage system discharging to the exterior of the units in the composite assembly.

In yet another skylight system, as contemplated in U.S. Pat. No. 4,642,466, by Sanneborn, at al., a flashing frame is described for roof windows to be installed adjacent to each other with edges facing each other in the installed position with a connecting flange of its upper flashing members extending beneath the roofing and, if need be, with its lower flashing members and required intermediary flashing members, obliquely outwardly bent connecting webs and each with a connecting bar with supporting webs which rearwardly engage the connecting webs being adjacent to the width of the installation distance and are obliquely bent inwardly on both sides, and at least one inner projection which engages between the facing corner edges of the connecting webs in the installed position, thus maintaining these corner edges at the installation distance.

In today's world of mandated energy efficiency in all types of buildings the metal building industry needs a more economical and less detrimental way to use skylights and smoke vents to daylight their buildings. To ensure adequate daylighting, however, typical skylight and smoke vent installations require multiple roof penetrations that cut through and remove plural major elevations in standing seam and other roof panel profiles. These curbs create multiple opportunities for water to enter the interior of the building, due to multiple curb locations and the width of the curbs, as well as the challenge to effectively seal the roof at the high end of such curbs.

The traditional curb constructions and methods of attachment in most cases require a complicated support structure to be installed below the roof panel which can restrict movement associated with the thermal expansion and contraction of the metal roof due to temperature changes and the like.

None of the prior approaches have been able to provide an installation system for multiple skylights that accomplishes all the goals of economy and simplicity of installation and will work equally well for new buildings and as a retrofit in existing buildings.

SUMMARY OF THE INVENTION

The invention provides a curbless construction system for installing two or more adjacent skylights and smoke vents end to end onto the major rib elevation of a building's metal roof system panel. Numerous roof structures include such elevations, sometimes deemed "ribs" or "corrugations", including the standing seam, snap seam and "R" panel roof types. The rail and closure system is fastened to the metal roof panels along the rib structures, so that the system can move with the expansion and contraction of the roof.

The invention utilizes elements of the roof surface structure as an integral part of the skylight support structure. In the preferred embodiment, the system includes a rail and closure assembly adapted to be supported on a major rib elevation a metal roof, typically where the elevation has been cut to accommodate drainage. The balance of the rib is to provide structural support for the rail assemblies.

Also in the preferred embodiment, the skylight/smoke vent system includes a skylight adapted to be supported on the rail and closure assembly, and a bearing plate structure for supporting and sealing the portion of the elevations that have been cut away preventing water accumulation at the surface, thus preventing water egress into the building.

In a further preferred embodiment, the invention provides a skylight system (including smoke vents) where the bearing plate structure cooperates with the rail and closure assembly to close the cut away portion to water egress.

In another preferred embodiment, the invention provides a skylight system where the metal roof is selected from the group of roofs comprising a standing seam roof, an architectural standing roof and a snap seam roof.

In another preferred embodiment, the invention provides a skylight system where the rib has been cut in only one location.

In a further preferred embodiment, the invention provides a skylight system where the standing seam roof has trapezoidial rib elevations.

In still further preferred embodiment, the invention provides a skylight system where the ribs are about 24" to about 30" on center.

In a different preferred embodiment, the invention provides a skylight system where the metal roof is selected from the group of roofs comprising an architectural standing roof and a snap seam roof, and where the vertical rib configurations are about 12" to about 18" on center.

In still further preferred embodiment, the invention provides a skylight system where the metal roof is an exposed fastener roof system.

In one preferred embodiment, the invention provides a skylight system where the rib has been cut in two locations.

In a different preferred embodiment, the invention provides a skylight system having a trapezoidial or rectangular rib elevation to 8" to 12" on center.

In another preferred embodiment, the invention provides a skylight system where the exposed fastener roof is of the type having roof panels fastened directly to the roof purlin from the top side of the roof panel.

In a further preferred embodiment, the invention provides a skylight system where the system comprises two or more skylights supported end to end.

In a different preferred embodiment, the invention provides a skylight system (including smoke vents) where each of the skylights are about 10 feet in length.

In one preferred embodiment, the invention provides a skylight system where the rail and closure assembly moves with the rib elevation.

In different preferred embodiment, the invention provides a skylight system further comprising a ridge cap configured to fit over the standing rib elevations at the ridge of the roof.

In a further preferred embodiment, the invention provides a skylight system where a lower closure of the skylight rail and closure assembly extends across the top of the metal roof panel profile.

In one preferred embodiment, the invention provides a skylight system where the closure is configured to match the roof panel surface adjacent rib elevations for sealing.

In a further preferred embodiment, the invention provides a skylight system where the closure is pre-cut to match the roof surface and adjacent rib elevations for sealing.

In a still further preferred embodiment, the invention provides a skylight system where the rail and closure assembly is fastened directly to the rib elevations using screws or rivets.

Where an extension is attached to the upper flange of the rail and closure assembly to effectively raise the height of the skylight or smoke vent to accommodate snow conditions and the like.

In a preferred embodiment the invention provides a skylight system further comprising a safety security guard attached to the rail assembly.

In a still further preferred embodiment, the invention provides a skylight system where the rail and closure assembly comprises an extended down leg on the inside of the roof cut away segment.

In another preferred embodiment, the invention provides a skylight system where the rail and closure assembly forms a water tight seal with the rib elevation.

In a preferred embodiment, the invention provides a skylight system where a side rail elevation attaches to the interior of the rib elevation.

In a further preferred embodiment, the invention provides a skylight system here the side rail elevation attaches to the anterior of the rib elevation.

In a different preferred embodiment, the invention provides a skylight system where a portion of the adjacent rib elevation is cut away to accommodate drainage along the roof surface.

In a still further preferred embodiment, the invention provides a skylight system where a portion at only one adjacent rib elevation is cut away to accommodate drainage along the roof surface.

In another preferred embodiment, the invention provides a skylight system where a portion at two or more adjacent rib elevations is cut away to accommodate drainage along the roof surface.

These and other features and advantages of this invention are described in, or are apparent from, the following detailed description of various exemplary embodiments of the apparatus and methods according to this invention.

BRIEF DESCRIPTION OF THE DRAWINGS

A more complete understanding of the present invention and the attendant features and advantages thereof may be had by reference to the following detailed description when considered in conjunction with the accompanying drawings wherein various figures depict the components and composition of the multiple skylight system.

DETAILED DESCRIPTION OF THE INVENTION

The products and methods of the present invention provide a skylight rail and closure system for use in installing various roof penetrating structures in metal roofs. For purposes of simplicity, "roof penetrating structures" and "skylights" will be used interchangeably to mean various forms of roof structures installed for passage of light and/or ventilation to the interior of the building. In the case of roof ventilation, examples include simple ventilation openings, such as for roof fans, and smoke vents, which are used to allow the escape of smoke through the roof during fires.

The number of skylights can vary from one to many structures connecting end to end be from one to as many as the building roof structure will support, limited only by the amount of support provided by the roof surface structure, which is left largely intact during the installation process.

The system utilizes the major rib structure in the roof as the primary support structure and water barrier to fasten the skylight assembly. Typical skylight installations do not allow for continuous runs, but use a curb construction that is typically 2-3 times wider than the present system.

The present skylight system does not require a complex structure underneath the panels or a separate curb construction to support or attach the skylight. The rail and closure assembly is overlaid onto the roof system and allows for thermal expansion and contraction by utilizing the major profiles of the metal roof panel for support. This is accomplished through direct attachment of the rail assembly and a combination of the panel flat and major ribs for support and attachment of the closure assembly.

In reference now to the figures, the system allows the installation of two or more adjacent skylights in an end to end fashion along the major rib structure of a building's metal roof panel profile.

Figure 1:
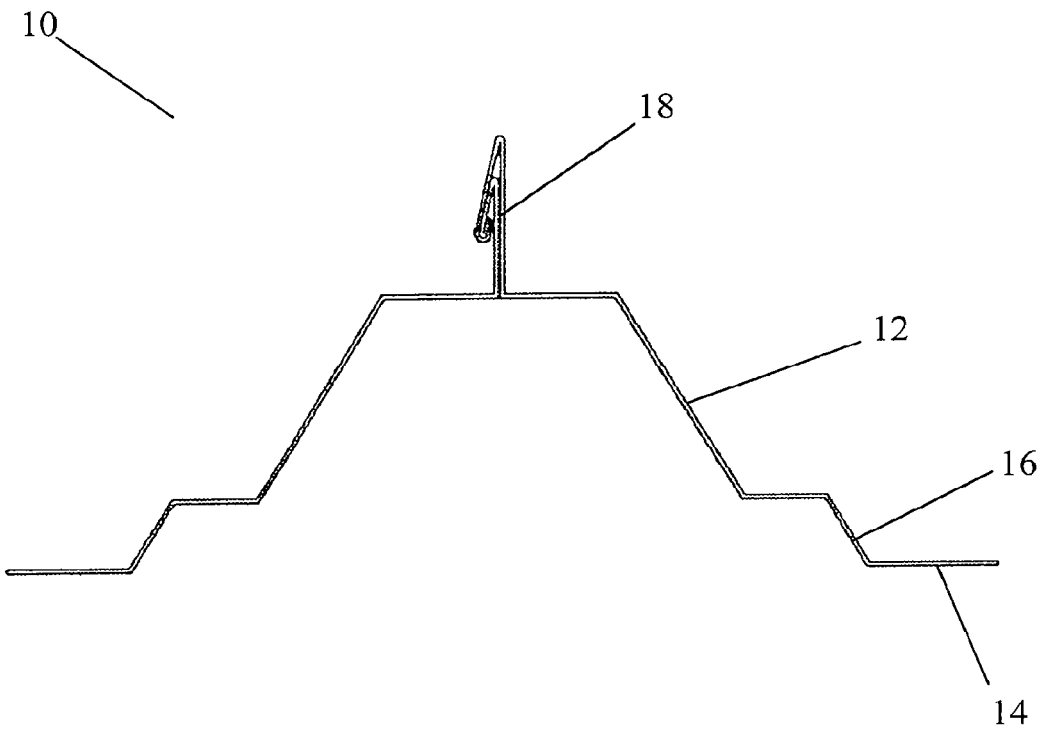
FIG. 1 is a view showing the roof profile of a metal roof of the type known as the standing seam roof panel.

The skylight system may be applied to various types of ribbed roof profiles. FIG. 1 is a view showing the roof profile of a metal roof of the type known as the standing seam roof panel 10. These include the "standing seam" roof, which has trapezoidal major ribs 12 typically 24" to 30" on center. Each panel 10 will also include the panel flat 14, having a shoulder 16 and seamed at adjacent panels forming a standing seam 18, which is folded over and seamed to prevent water from penetrating the roof.

Figure 2:
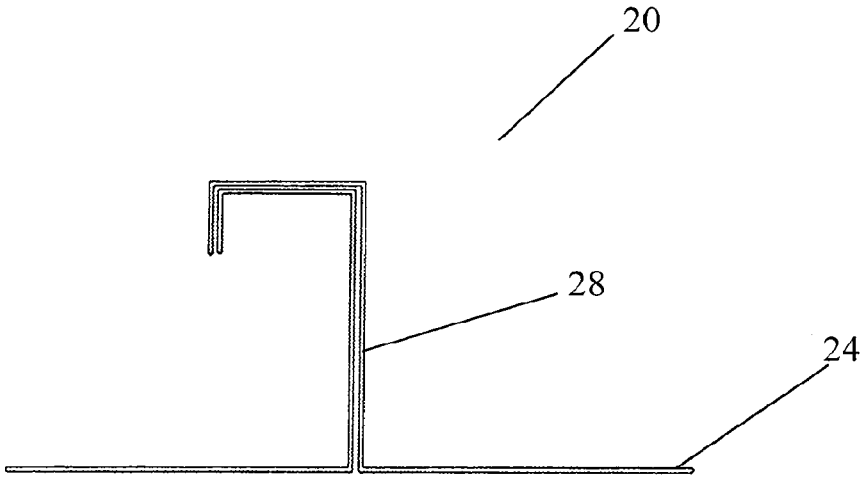
FIG. 2 is a view showing the roof profile of a metal roof of the type known as an architectural standing seam roof.

FIG. 2 is a view showing the roof profile of a metal roof of the type known as an architectural standing seam roof, produced of a series of overlapping architectural standing seam panels 20. Each panel 20 comprises a panel flat 24, with an architectural standing seam 28 formed at the interconnecting panels.

Figure 3:
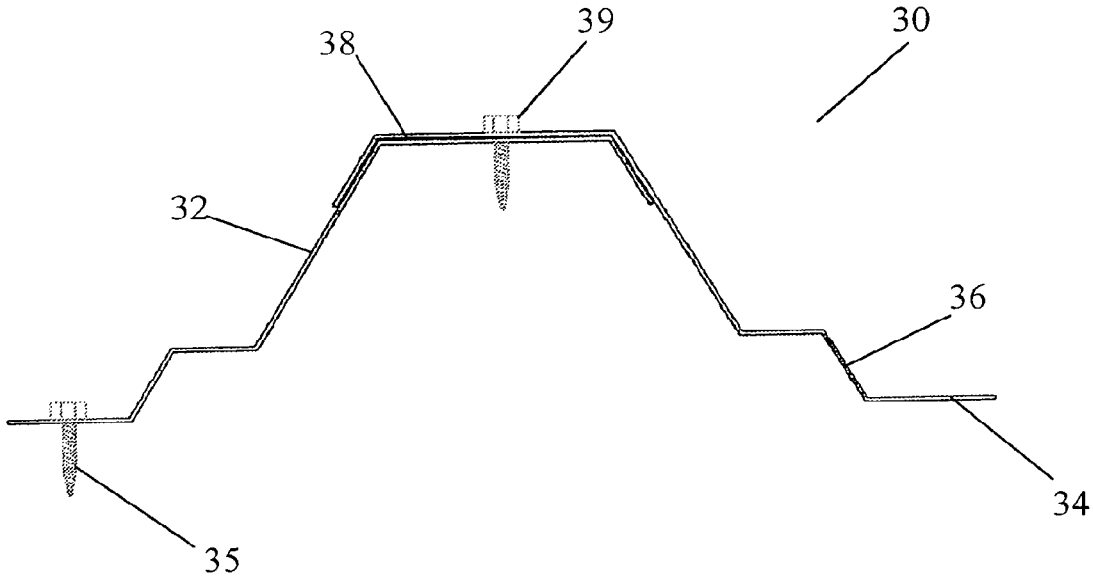
FIG. 3 is a view showing the roof profile of a metal roof of the type commonly referred to as a snap seam roof.

FIG. 3 is a view showing the roof profile of a metal roof of the type commonly referred to as an R panel or exposed fastener panel 30, with each panel having a rib 32, panel flat 34. Adjacent R panels are secured to the roof through a structural fastener 35, and at the shoulder 36 which is formed from overlapping regions, or side lap 38, the adjacent panels are secured through a stitch fastener 39. The trapezoidal major ribs of the R panel roof are most typically formed at 8" to 12" on center.

Figure 4:
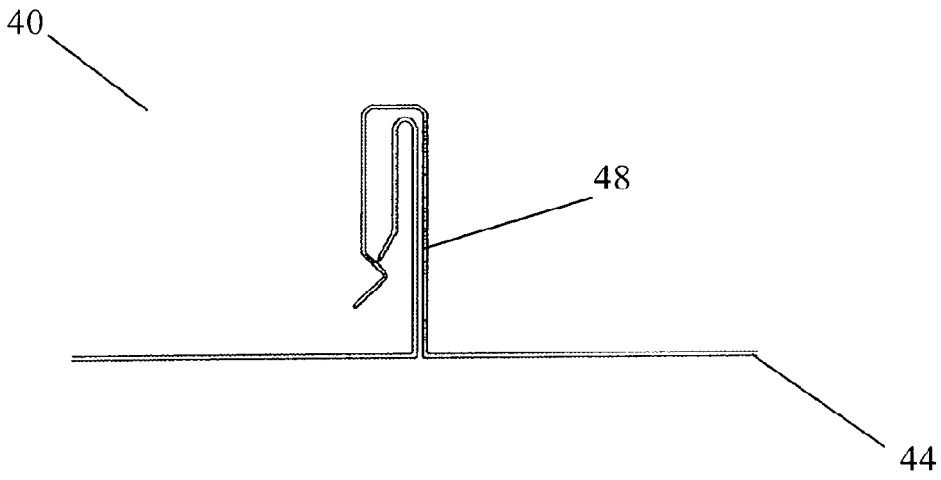
FIG. 4 is a view showing the roof profile of a metal roof of the type commonly referred to as an exposed fastener roof panel.

FIG. 4 is a view showing the roof profile of a metal roof of the type commonly referred to as a snap rib seam panel 40. Snap seam panels 40 have a panel flat 44 and a standing seam or snap seam 48 at adjacent panels.

Figure 5:
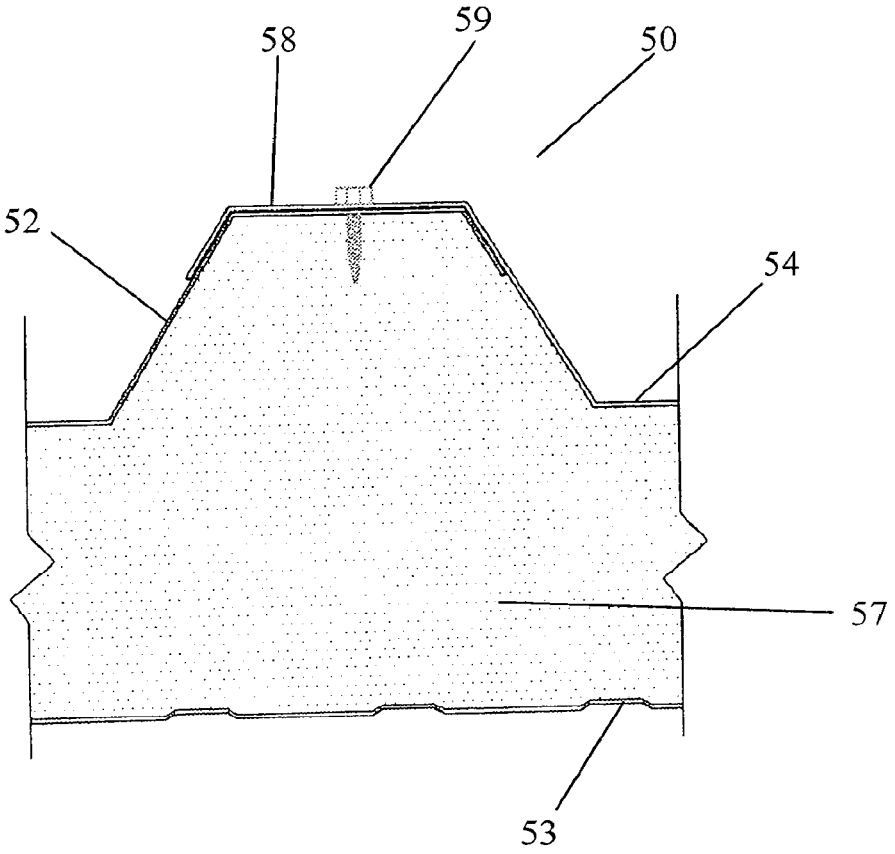
FIG. 5 is a view showing the roof profile of metal roof of the type commonly known as foam core panel.

FIG. 5 is a view showing the roof profile of a metal roof of the type commonly known as foam core panel 50, which has a rib 52, a liner panel 53, a panel flat 54 and a foam core 57. Side laps 58 are secured by a stitch fastener 59. This panel is typically installed from the interior of the building.

The system includes a rail and closure assembly adapted to be supported onto the major elevations, seams, rib structures, or other structural elements of such roof profiles, where the standing structure provides the support, and the skylight is secured through an opening formed in the intervening, non-structural roof flat region.

Figure 6:
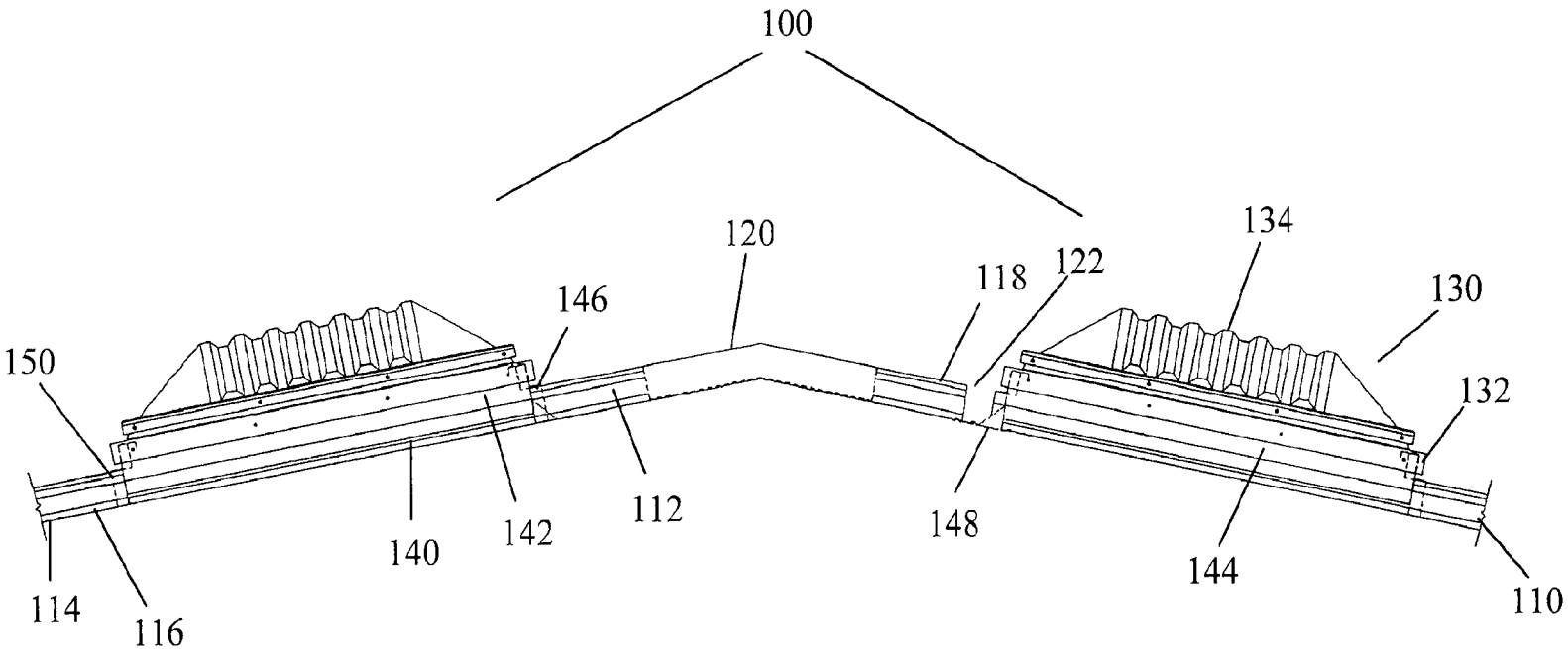
FIG. 6 is a side view showing the major components of the system as installed on a metal roof.

Turning now to FIG. 6, there is shown an exemplified rail and closure assembly 100 adapted for attachment to a standing seam panel roof 110. While the following figures depict such an assembly, it will be understood that the components could easily be adapted, by shaping of the elements, for attachments to any roof system that has a profile with elevations providing a place for structural support.

Figure 7:
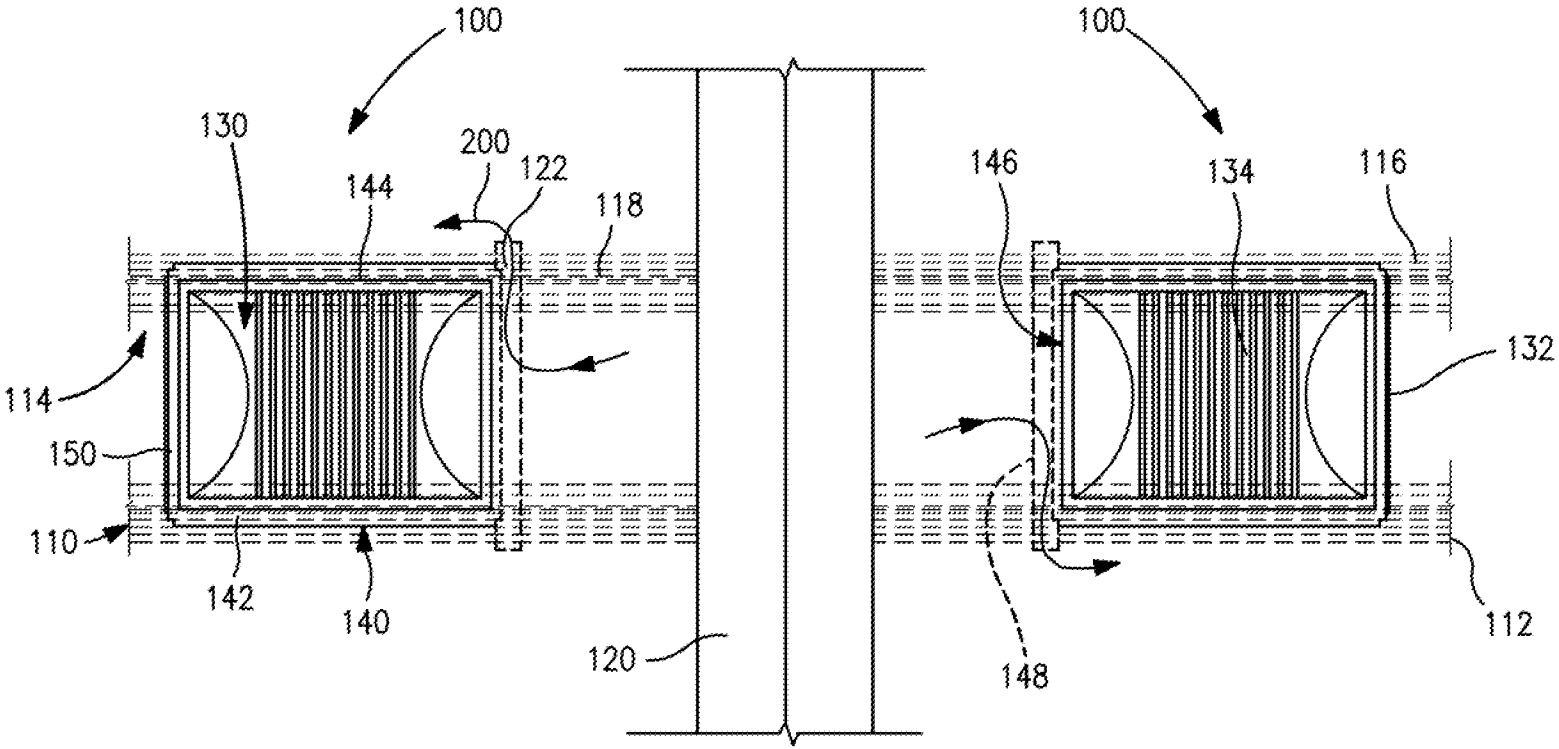
FIG. 7 is a top plan view of the installed system, showing the placement of skylights and the direction of water flow over the roof.

Looking again to the figures, particularly FIGS. 6 and 7, there is shown such a standing seam panel roof 110 having structural and other elements including a raised rib 112, a panel flat 114, shoulder 116 and standing seam 118. Also depicted are the ridge cap 120 of the roof structure, and a series of cutaway regions, or gaps 122 formed to accommodate the structure, as described more fully as follows.

Shown as part of the system, and exemplified in this case, is a skylight 130, generally comprising a skylight frame 132 and skylight lens 134. While the figures depict a skylight, it will be understood that the system could also be adapted for use with any number of roof penetrating structures, from various types of skylights to smoke vents or other ventilating structures, which can all be adapted to be supported on the rail and closure assembly system.

Again in reference to FIGS. 6 and 7, the system includes a rail and closure structure 146, generally comprised of side rails 142 and 144, and upper diverter 146 disposed at the rib cutaway section, or gap 122. At this gap 122 a plate 148 may be located under the gap 122 to prevent water leakage from roof. In assembling the rail and closure structure to a roof, the plate 148 may be sealed and fastened securely to the roof panel supports.

Looking more particularly to FIG. 7 it is shown how the gap 122 in the roof rib 112 allows water flow 200 along the roof surface, over plate 148, and down and away from the roof ridge cap 120.

The rail and closure assembly structure 140 may also include a lower closure 150 to seal the system from the elements.

Figure 8:
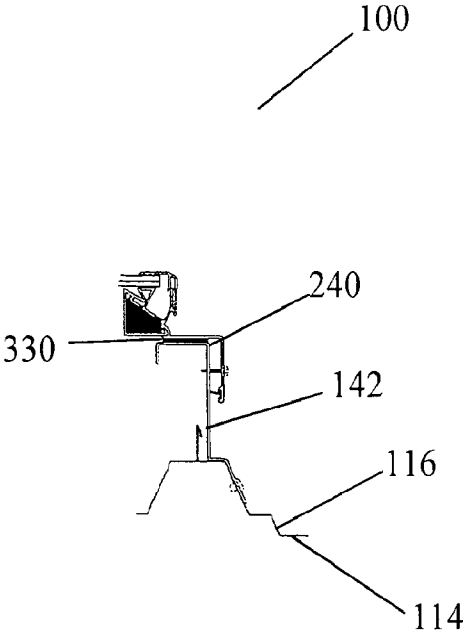
FIG. 8 is a cross sectional view showing the connections of the skylight frame to the rail and closures structure, and the latter affixed over the outer surfaces of adjacent rib elevations of the metal roof.
Figure 8:
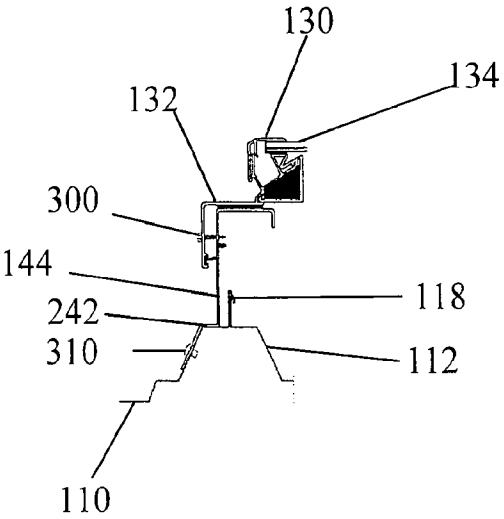

In reference now to FIG. 8, there is shown a cross section through the skylight 130 region of the rail and closure structures 100, showing the securement of the assembly 100 to the standing seam panel roof 110. In particular, FIG. 8 depicts the use of the rib 112 to support the side rails 142 and 144. It is seen that each rail 142 or 144, has a rail upper flange or bearing surface 240 and a rail shoulder 242. The rail 142 or 144 is secured to the skylight frame 132 by the a fastener 300.

The rail shoulder 242 is shaped to fit closely over outside of the roof rib 112, and is secured to roof rib 112 by a rivet 310. The rail bearing surface 240 supports the skylight frame 132, where a sealant 330 can be applied to seal against the passage of water or air.

Figure 9:
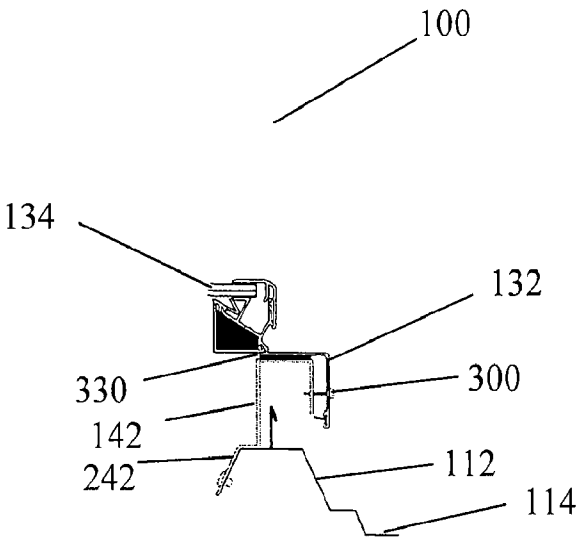
FIG. 9 is a cross sectional view showing an alternative arrangement for the elements shown in FIG. 8, only with the rail and closure structure connecting along the inner faces of adjacent rib elevations.
Figure 9:
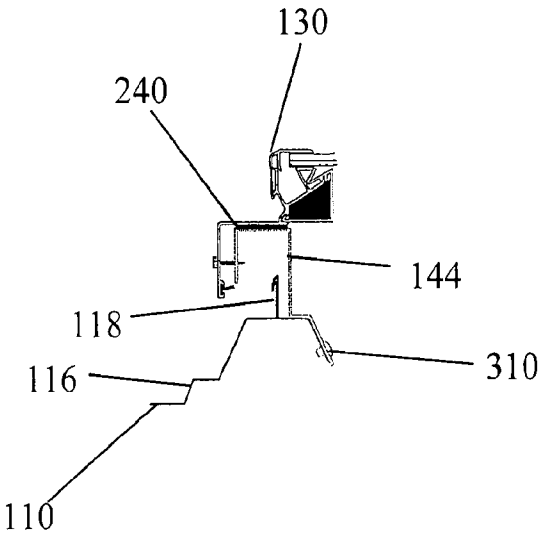

FIG. 9 depicts a variation of the rail and closure assembly 100 shown in FIG. 8, only where the rail shoulder 242 is shaped to fit closely along the inside of the roof rib 112, and is secured to roof rib 112 by rivet 310. As for FIG. 8, the rail bearing surface 240 similarly supports the skylight frame 132, where a sealant 330 can be applied.

It can be seen that the rail and closure structure 140 of the assembly 100 can be produced to fit closely along the contour of the roof 110, and can be so configured to have end portions that match the contour of the ribs 112. The various mating surfaces of the structure 140 and the roof 110 can be sealed in various ways known to the roofing art, including caulking or tape mastic, or various rubber fittings or inserts can be provided be used to seal the open area of the panel roof.

Figure 10:
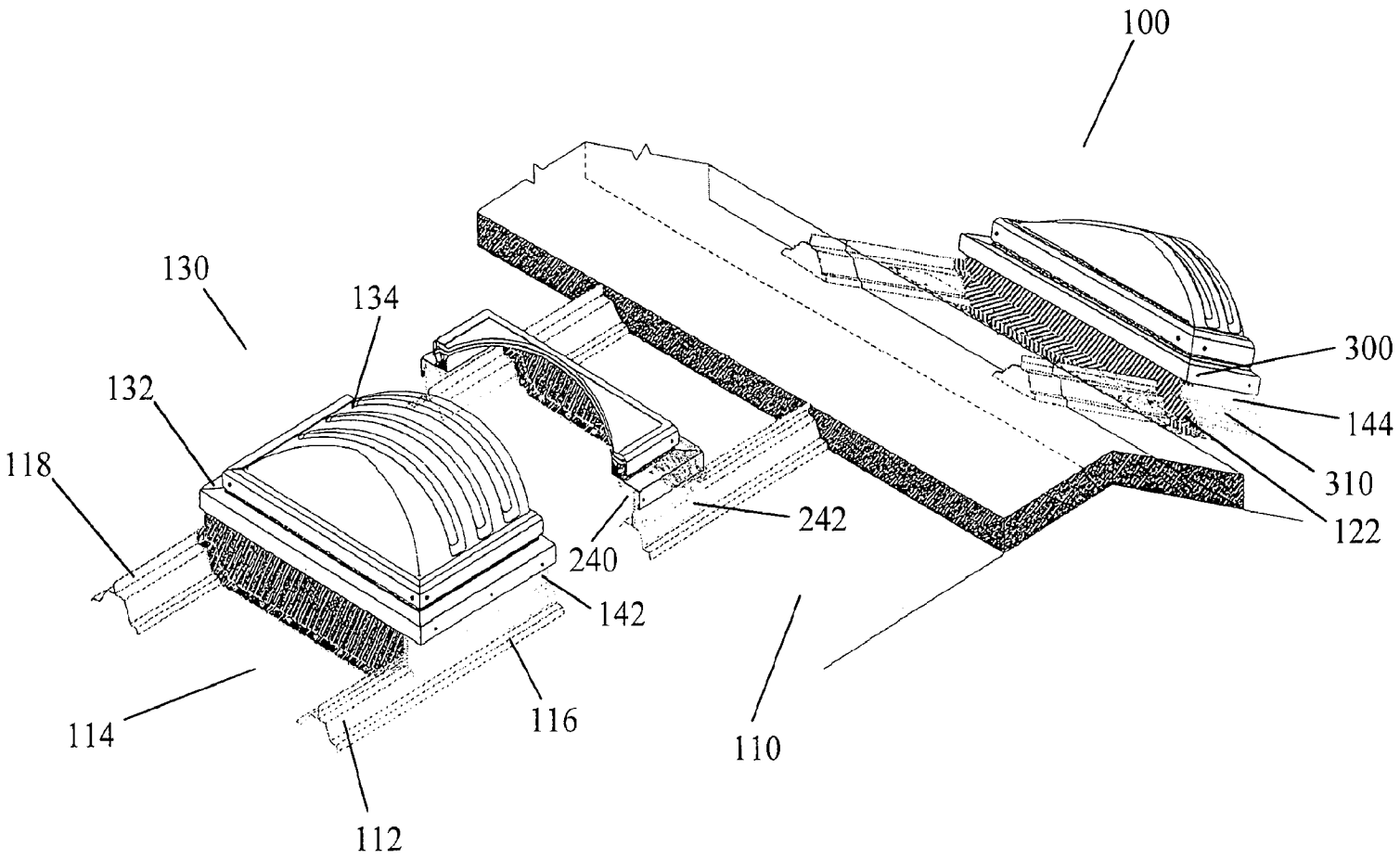
FIG. 10 is a perspective view partially cut way showing internal structure of the system as installed on the rib elevations of a metal roof.

In FIG. 10 a partially cut away perspective view of the rail and closure structure 100 is used to show the support of the rail and closure system by the standing seam panel roof 110, particularly the elevated rib 112 providing the structural support. In FIG. 10 it is seen how the rail and closure system incorporates the structural profile of the upper panels of metal roof structure, the elevations and ribs used in sealing adjacent panels, to provide the support of adjacent skylights. In this fashion, the system adopts various advantages of a standing seam roof.

Most standing seam roofs are seamed using various clip assemblies that allow the roof to float, along the major elevation. Typically, the roof is fixed at eave and allowed to expand and contract over at ridge. Very wide roofs can be fixed at midspan and expand towards both the eave and ridge. The design of the skylight system takes full advantage of the floating features of contemporary roofing structures, and when a skylight is so secured to the elevations, the skylight assemblies themselves are able to draw strength from the structural load bearing capacity of the roof profile.

Shown in FIG. 10 is the panel flat 114, rib 112 and shoulder 116, as well as the standing seam 18. The ridge cap 120 is also shown, as well as the gap in the roof 122.

The skylight 130 is supported on the rail and closure structure 140, as previously described.

The rail and closure structure 140 is secured by its side rails 142 and 144 by a series of fasteners 300 to the skylight frame 132 and to the ribs 112 by a series of rivets 310.

In application, from each structure 140 a single rib 112 is typically cut away to accommodate drainage at the high end of the system (toward ridge cap 120). This is an important feature for standing seam, architectural standing seam and snap seam roofs. Two ribs may be cut for roofs having an "R" panel profile.

The retained portions of rib 112 serve as a beam to support the side rails 142 and 144 and maintain a watertight seal along the length of the assembly. Internal portions of the ribs 112 may be removed to allow additional light from the skylight 130.

A single bearing plate structure 148 is used for sealing the cut away rib. The bearing plate 148 also provides some support to link adjacent rib elevations 112, and is typically produced of steel or other material sufficient to provide a rigid substructure to the skylight rail and closure structure.

The rail and closure structure 140 is shaped in such a manner that the skylight can be easily fastened directly to the rail portion, with rivets or fasteners such as screws and the like. The rail and closure structure 140 may also be designed to accept a safety security guard before the skylight is installed.

Figure 11:
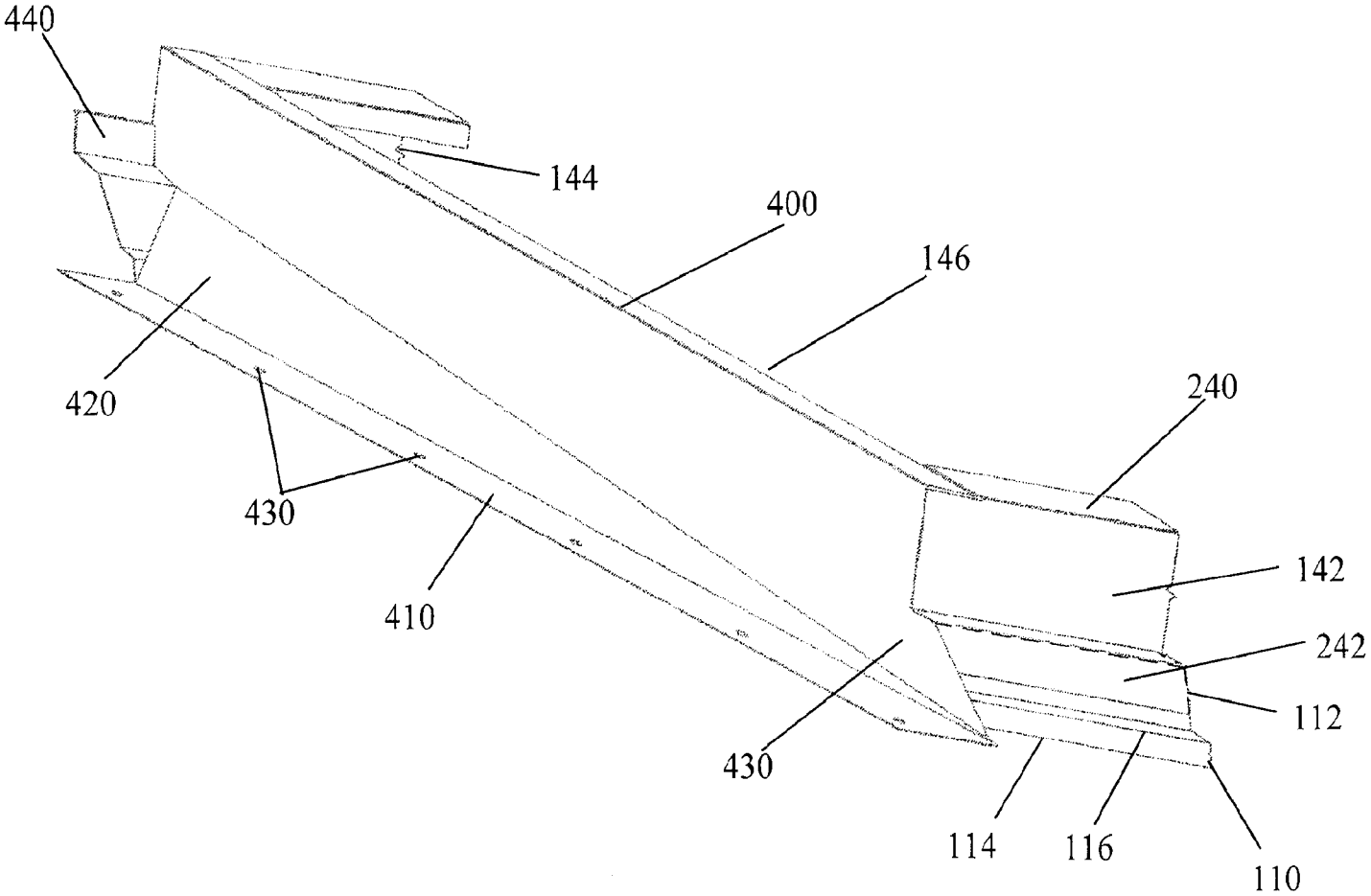
FIG. 11 is a perspective view of the upper rain pan or diverter of the rail and closure structure.
Figure 12:
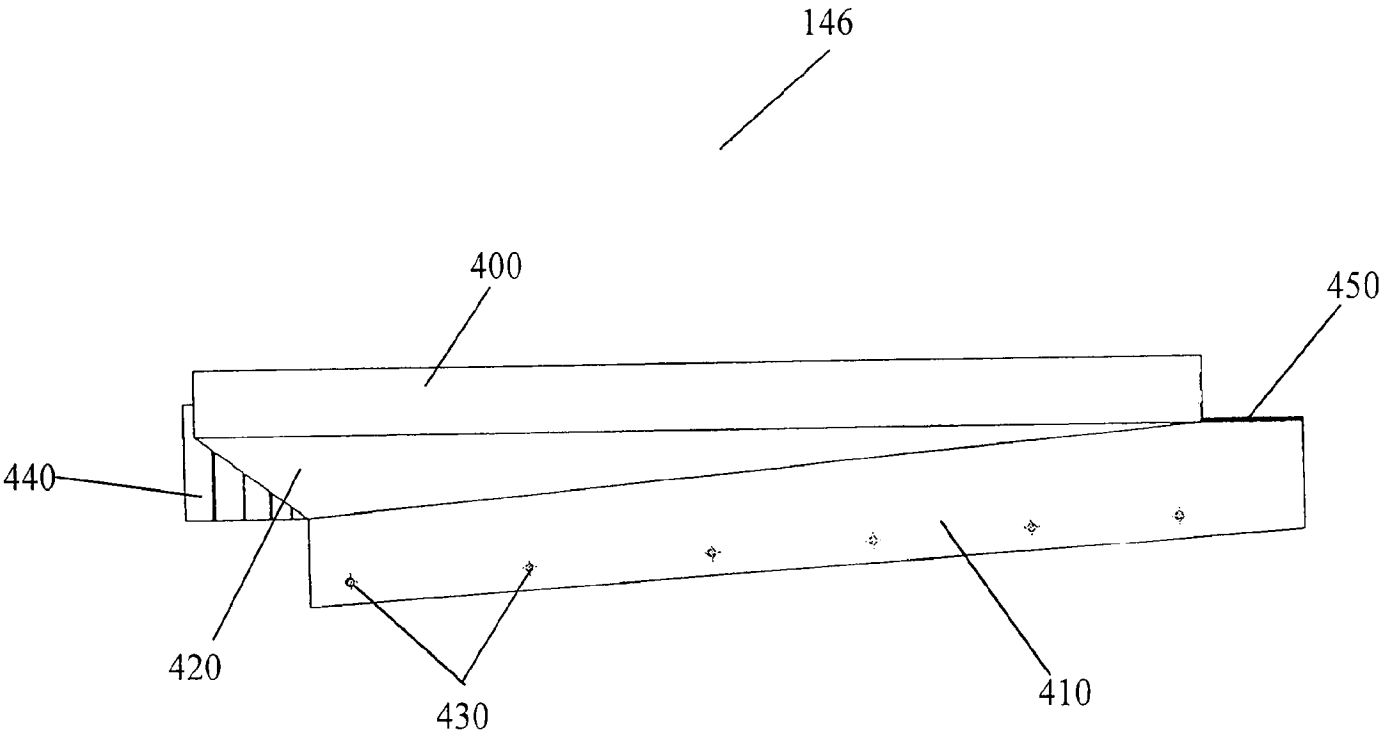
FIG. 12 is a top view of the upper rain pan or diverter of the rail and closure structure.
Figure 13:
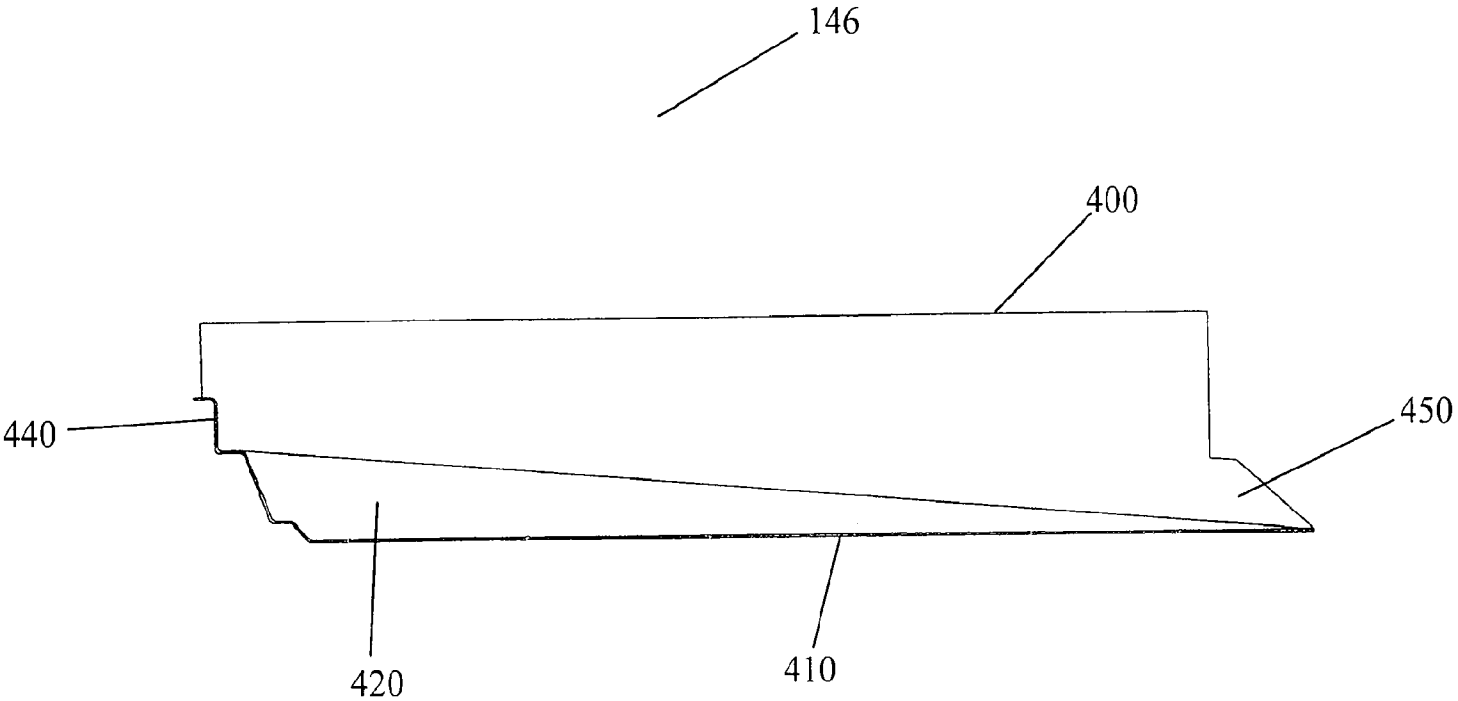
FIG. 13 is a front plan view of the upper rain pan or diverter of the rail and closure structure.

Looking now to FIGS. 11 through 13, an upper or high end diverter 146 provides closure and diversion of water around the top of the assembly to an adjacent panel flat. Diverter 146 also provides a weather tight seal at the upper end of the assembly, with the plate 148 (not shown). In reference to the side rails 142 and 144 of a standing seam panel roof 110, the diverter 146 generally fits the profile of the rib 112 at the region of the cut away gap 122. The side rails 142 and 144 abut the diverter 146 and the height of the diverter 146 closely matches them in height. The upper flange 400 of the diverter 146 actually acts with upper flanges 240 of the side rails 142 and 144 to form the bearing surface of the skylight frame.

The diverter 146 lower flange 410 runs along the panel flat 114. The diverter 146 also has a diversion surface 420 and fastener holes 430 along the lower flange.

At one end is a rib mating surface 440 and at the other a rib sealing plate 450 is formed.

Figure 14:
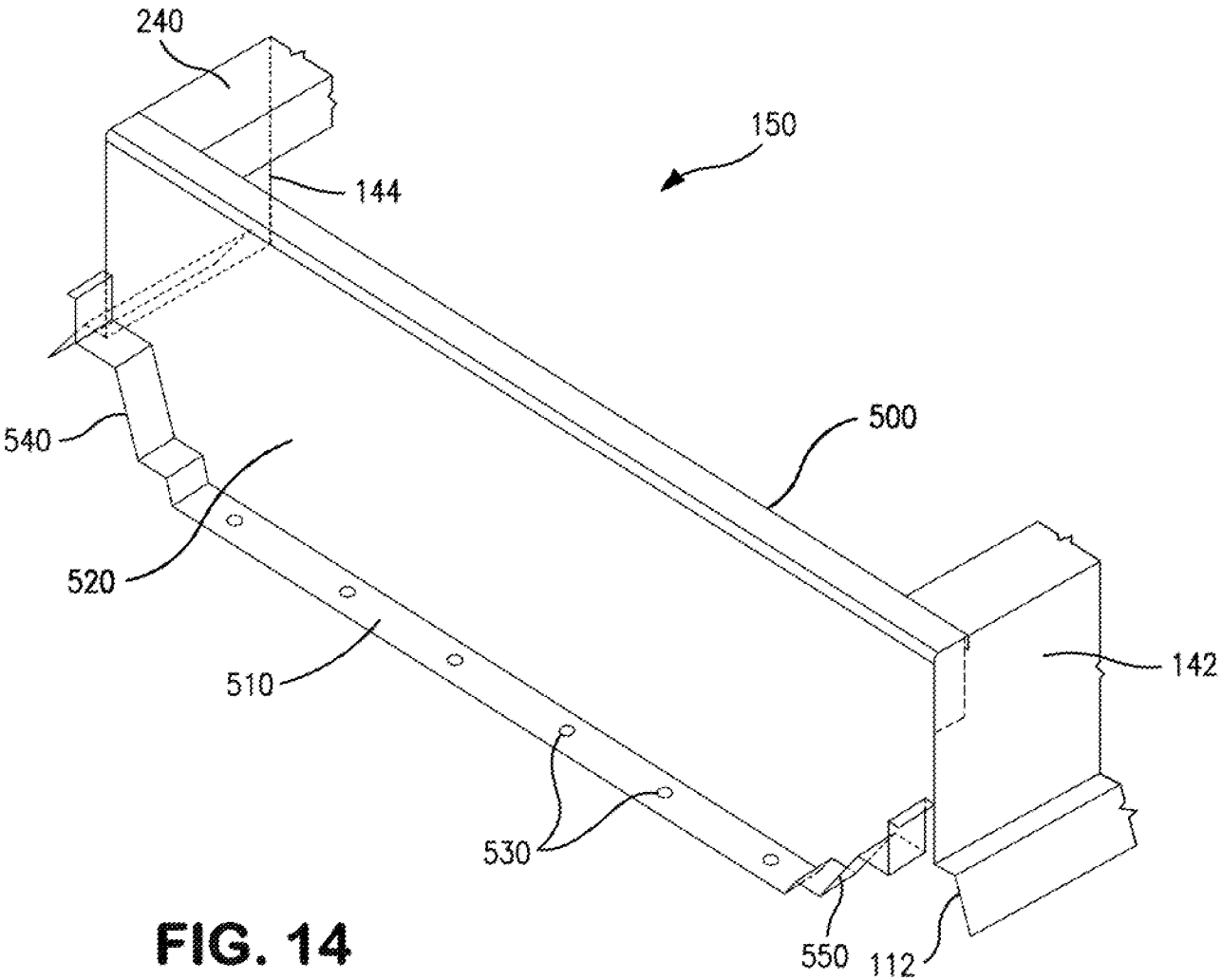
FIG. 14 is a perspective view of the lower rain pan or lower closure of the rail and closure structure.
Figure 15:
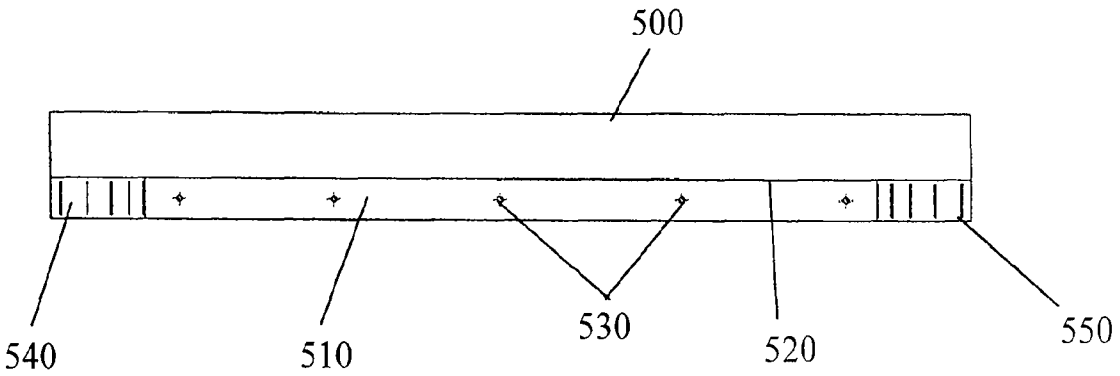
FIG. 15 is a top view of the lower rain pan or lower closure of the rail and closure structure.
Figure 16:
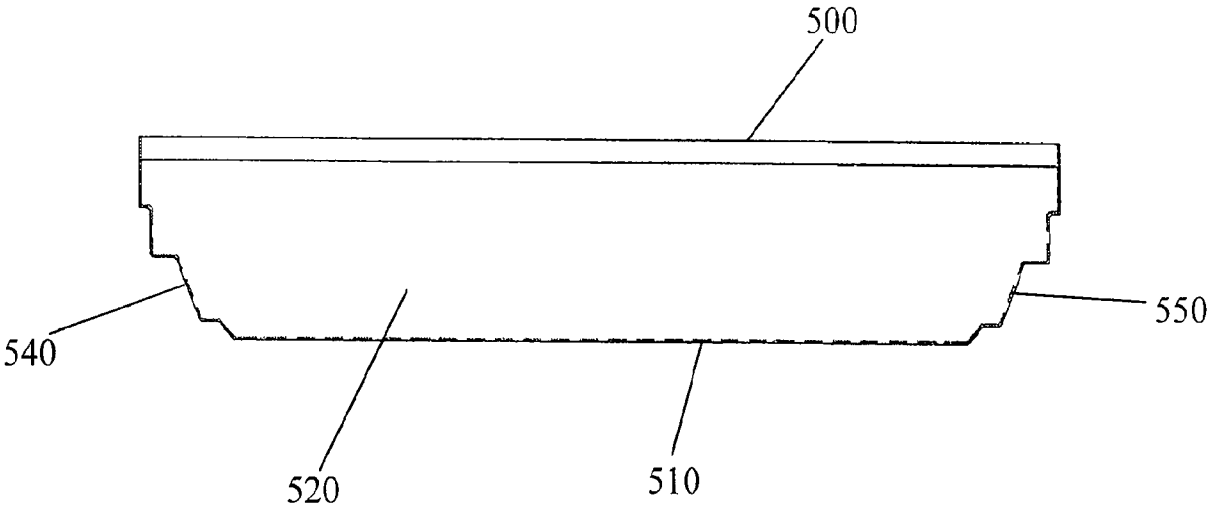
FIG. 16 is a front plan view of the lower rain pan or lower closure of the rail and closure structure.

FIGS. 14 through 16 shows the low end closure 150 that is used to maintain a weather tight seal at the lower end of the assembly. Shown again in reference to the side rails 142 and 144 of a standing seam panel roof 110, the closure 150 is adapted to fit the profile of the rib 112. The side rails 142 and 144 abut the closure 150 and the height of the closure 150 matches them in height.

Looking to the closure 150, it is seen to have an upper flange 500 and a lower flange 510, as well as a closure web 520. The lower flange 510 includes fastener holes 530.

The closure 150 also includes rib mating surfaces 540 and 550 to provide a tight fit along the ribs 112.

Figure 17:
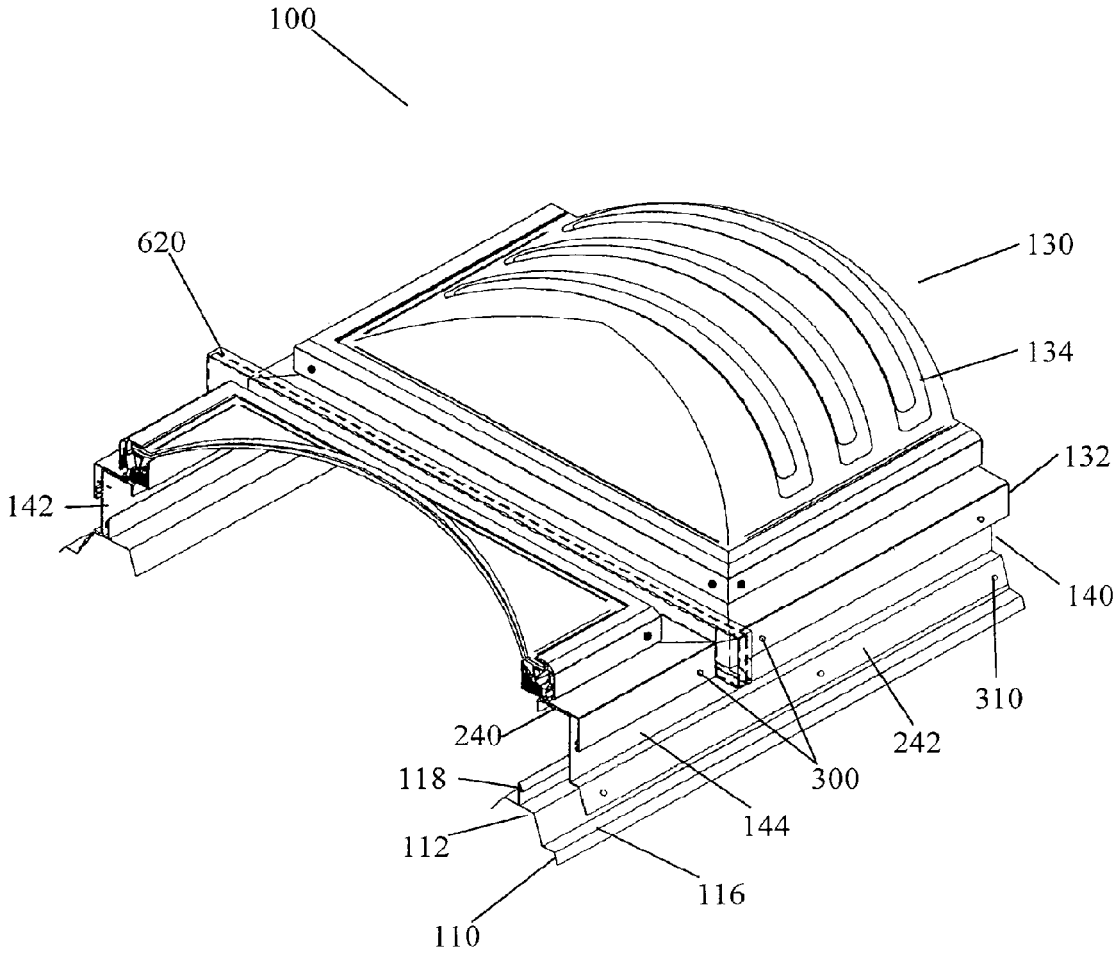
FIG. 17 is a perspective and partially cut away view showing a connection of adjacent skylights of the system.
Figure 18:
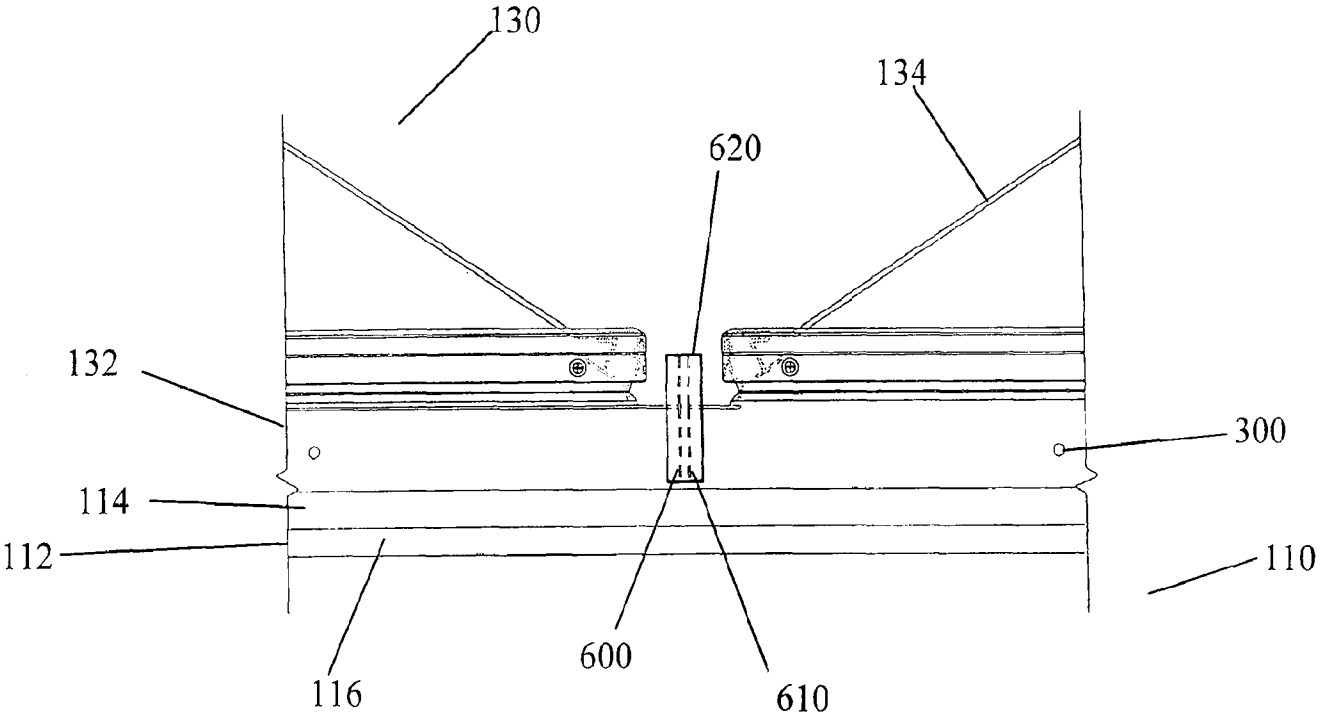
FIG. 18 shows detail of how the batten connects adjacent skylights and prevents water egress between them.

Looking now to FIGS. 17 and 18, the adaptation of the system for the application of multiple roof penetrating structures is described. A chief aspect of the assembly 100 is the reduction in the number of roof penetrations required to provide daylight to the interior of a structure, as fewer, longer cuts can be made along the roof elevations. These minimized openings can be maintained along a single rib, if desired, with one continuous opening versus many smaller ones permitting an equal or greater amount of ambient light into the building.

In the case of standing seam roofs the system provides the ability to remove only a portion of the bottom flat of the panel. This maintains the structural integrity of the roof in that multiple sections of major panel elevations are not removed, as is done to accommodate a "typical" curb assembly. Thus, the roofs structural integrity is not compromised to that extent and there are fewer potential areas for water infiltration, in that the skylight panels can be attached very near the ridge of the building and run to the cave requiring water to be diverted only once near the ridge of the roof plane and only across one panel flat.

To the limited extent that cutaways are made to the elevations, these are made small, on the order of a few inches or less, solely for the purpose of allowing drainage past the skylights.

The rail system is designed to install to either the inside or outside of the major rib elevation for any of the aforementioned roof panel profiles.

The rail and closure assembly 100 is particularly useful for continuous runs of skylights end to end. FIG. 17 shows how two adjacent skylights of the rail and closure assembly 100 can be affixed along a standing seam panel roof 110. Instead of producing the lights with diverters and lower closures, where adjacent lights abut, the rail and curb structures 140 are provided with upper and lower standing rib frames 600 and 610 at adjacent ends of the adjacent structures 140. A batten 620 is provided to secure the system 100 against the elements.

FIG. 18 is a side elevational view of the batten 620, showing how it fits over the adjacent upper and lower standing rib frames 600 and 610.

As only one example, skylights can be produced in units of up to 10 feet long, and connected in this fashion for as long as necessary, as each skylight unit is supported by the primary rib of the profile. The standing rib elevation (the major corrugation) runs longitudinally along the length of the assembly and mates along the entire assembly 100, regardless of the number of adjacent structures 140. No water can enter over the top of the rail and closure assembly.

Where it is desired that the skylight starts at the ridge of the roof, a simple flashing can be inserted under the ridge cap.

Where the ridge cap has a configuration to fit the rib elevations (major corrugations) in the roofing panels, a portion of the one rib may be cut out (approximately 2"), allowing the water from the roof panel above to be diverted on to the next panel.

If desired, a simple rail enclosure extension could be used to increase the height or distance between top skylight frame and the roof panel, and can be adapted to simply lay over or attach to the top of the rail and closure assembly. Such an extension could be produced to rest along the upper flange of the rail and closure assembly, to effectively raise the height of the skylight or smoke vent to accommodate different skylight depths or other design features, or to accommodate snow conditions and the like. In this fashion, the rail and closure structure can be produced to a standard height, with varying extensions used to elevate the overall height of the structure for such varied purposes. Various forms for such an extension would be suitable, and the skilled artisan will understand various ways and means of designing and manufacturing these to accomplish the goal of added height to the skylight.

While this invention has been described in conjunction with the specific embodiments outlined above, it is evident that many alternatives, modifications and variations will be apparent to those skilled in the art. Accordingly, the preferred embodiments of the invention, as set forth above, are intended to be illustrative, not limiting. Various changes may be made without departing from the spirit and scope of this invention.

What is claimed is:

1. A rail mounting system for mounting a skylight or other load on a metal panel roof system having panel flats, and rib elevations extending upwardly from such panel flats, said rail mounting system comprising first and second side rails for supporting opposing sides of such skylight or other load, each of said side rails having a profile configured to attach to a such rib elevation and to provide structural support for the skylight or other load along substantially an entire length of such skylight or other load, said side rail comprising:

(a) an upstanding riser;

(b) an upper flange extending from said upstanding riser; and (c) a bottom shoulder structure extending from said upstanding riser, said bottom shoulder structure comprising a first shoulder element attached directly to said upstanding riser, said first shoulder element extending along the length of said side rail, and laterally away from said upstanding riser, said first shoulder element having a first surface facing in a first direction having a downwardly-directed component, said bottom shoulder structure further comprising a second shoulder element attached directly to said first shoulder element, said second shoulder element extending in a second direction, different from the first direction, to a distal edge of said bottom shoulder structure, said second shoulder element having a second downwardly-directed component, said rail mounting system further comprising:

upper and lower end closures extending upwardly from the panel flat and cooperating with first and second next adjacent ones of said side rails.

2. A rail mounting system as in claim 1, said bottom shoulder structure extending, from said upstanding riser, in a direction away from said upper flange.

3. A rail mounting system as in claim 1 wherein said first shoulder element extends, from said upstanding riser, at a generally perpendicular angle with said upstanding riser, and said second shoulder element extends from said first shoulder element, in a relatively downward direction.

4. A rail mounting system as in claim 1 wherein said upstanding riser has a top and a bottom and wherein said upper flange extends from the top of said upstanding riser.

5. A rail mounting system as in claim 1 wherein said upstanding riser has a top and a bottom and wherein said bottom shoulder extends from the bottom of said upstanding riser.

6. A rail mounting system as in claim 1 wherein said upstanding riser has opposing first and second major surfaces, and wherein said upper flange extends laterally away from the first surface of said upstanding riser and said bottom shoulder extends laterally away from the second opposing major surface of said upstanding riser and laterally away from said upper flange.

7. A rail mounting system as in claim 1, said rail mounting system enclosing an area of such roof and being adapted to support a such load mounted thereon while closing off access to the area underneath such load.

8. A rail mounting system mounted on a metal panel roof, and adapted to receive a skylight or other load, the metal panel roof having panel flats, and rib elevations extending upwardly from such panel flats, said rail mounting system comprising first and second side rails for supporting opposing sides of such skylight or other load, each of said side rails having a profile configured to be fastened to a such rib elevation and to provide structural support for the skylight or other load along substantially an entire length of such skylight or other load, each said side rail comprising an upstanding riser having first and second opposing major surfaces, an elongate bottom shoulder structure extending from the first surface of said upstanding riser and fastened to an upstanding portion of such rib elevation by screws or rivets; and an upper flange extending from the second opposing surface of said upstanding riser, in a direction away from said bottom shoulder structure.

9. A rail mounting system as in claim 8, said elongate bottom shoulder structure having a first shoulder element attached directly to said upstanding riser, said first shoulder element having a first elongate surface extending along the length of said side rail, and facing in a direction having a downwardly-directed component, the elongate surface having a first surface element extending, from said upstanding riser, laterally away from said upstanding riser, said bottom shoulder structure further comprising a second shoulder element attached directly to said first shoulder element, said second shoulder element extending in a second direction, different from the first direction to a distal edge of said bottom shoulder structure, said second shoulder element having a second surface, having a second different, downwardly-directed component.

10. A rail mounting system as in claim 9 wherein said first shoulder element extends, from said upstanding riser, at a generally perpendicular angle with said upstanding riser, and said second shoulder element extends from said first shoulder element, in a downward direction.

11. A rail mounting system as in claim 9 wherein said upstanding riser has a top and a bottom and wherein said bottom shoulder structure extends from the bottom of said upstanding riser.

12. A rail mounting system as in claim 9 wherein said second shoulder element extends to a distal edge of the respective said rail.

13. A rail mounting system, including upper and lower end closures extending upwardly from the panel flat and connecting to first and second next adjacent said side rails of claim 8, said rail mounting system enclosing an area of a roof and being adapted to support a load mounted thereon while closing off access to the area underneath such load.

14. A rail mounting system for mounting a skylight or other load on a metal panel roof system having panel flats, and rib elevations extending upwardly from such panel flats, said rail mounting system comprising first and second side rails for supporting opposing sides of such skylight or other load, each of said side rails having a profile configured to attach to a such rib elevation and to provide structural support for the skylight or other load along substantially an entire length of such skylight or other load, a said side rail comprising:

(a) an upstanding riser;

(b) an upper flange extending from said upstanding riser; and (c) a bottom shoulder structure extending from said upstanding riser, said bottom shoulder structure comprising a first shoulder element attached directly to said upstanding riser, said first shoulder element extending along the length of said side rail, and laterally away from said upstanding riser, said first shoulder element having a first surface facing in a first direction having a downwardly-directed component, said bottom shoulder structure further comprising a second shoulder element attached directly to said first shoulder element, said second shoulder element extending in a second single direction, different from the first direction, to a distal edge of said side rail.

15. A rail mounting system as in claim 14, said rail mounting system further comprising upper and lower end elements connected to said first side rail and extending across and above the respective said panel flat, and connected to said second side rail.

16. A rail mounting system for mounting a skylight or other load on a metal panel roof system having panel flats, and rib elevations extending upwardly from such panel flats, said rail mounting system comprising first and second side rails for supporting opposing sides of such skylight or other load, each of said side rails having a profile configured to attach to a such rib elevation and to provide structural support for the skylight or other load along substantially an entire length of such skylight or other load, a said side rail comprising:

(a) an upstanding riser;

(b) an upper flange extending from said upstanding riser; and (c) a bottom shoulder structure extending from said upstanding riser, said bottom shoulder structure comprising a first shoulder element attached directly to said upstanding riser, said first shoulder element extending along the length of said side rail, and laterally away from said upstanding riser, said first shoulder element having a first surface facing in a first direction having a downwardly-directed component, said bottom shoulder structure further comprising a second shoulder element attached directly to said first shoulder element, said second shoulder element extending in a second single direction, different from the first direction;

said rail mounting system further comprising:

upper and lower end elements connected to said first side rail and extending across and above the respective said panel flat, and connected to said second side rail.

* * * * *